US006366034B1

(12) United States Patent
Kwon et al.

(10) Patent No.: US 6,366,034 B1
(45) Date of Patent: Apr. 2, 2002

(54) ELECTRIC CURRENT VARIABLE-TYPE INDUCTOR HAVING CLOSED LOOP CHARACTERISTICS AND A HORIZONTAL LINEARITY COMPENSATION CIRCUIT

(75) Inventors: Joong-Yeol Kwon; Kil-Soo Park, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/640,050

(22) Filed: Aug. 17, 2000

(30) Foreign Application Priority Data

Dec. 28, 1999 (KR) ..... 99-63450

(51) Int. Cl.[7] ..... G09G 1/28

(52) U.S. Cl. ..... 315/368.25; 315/364; 315/371; 336/87; 336/214; 336/221

(58) Field of Search ..... 315/364, 368.25, 315/368.28, 370, 371, 399, 411; 336/84 R, 87, 212, 214, 221; 323/355, 356, 362, 335, 205, 206

(56) References Cited

U.S. PATENT DOCUMENTS 4,393,157 A * 7/1983 Roberge et al. ..... 323/355
4,423,358 A * 12/1983 den Hollander ..... 315/371
4,500,816 A * 2/1985 Murphy ..... 315/368
4,516,058 A * 5/1985 Haferl ..... 315/370
4,583,068 A * 4/1986 Dickens et al. ..... 336/82
4,654,564 A * 3/1987 Lehnert ..... 315/400
5,962,994 A * 10/1999 Kwon et al. ..... 315/408
6,124,778 A * 9/2000 Rowley et al. ..... 336/200
6,274,989 B1 * 8/2001 Truskalo ..... 315/370

* cited by examiner

*Primary Examiner*—Haissa Philogene
(74) *Attorney, Agent, or Firm*—Robert E. Bushnell, Esq.

(57) ABSTRACT

A current variable inductor having closed loop characteristics and a horizontal linearity compensation circuit. The current variable inductor having the closed loop characteristics is constructed with the legs of the first E-shaped core and the legs of the second E-shaped core extend toward each other, an I-shaped core is arranged between the first E-shaped core and the second E-shaped core such that the I-shaped core is in contact with the first E-shaped core, and the I-shaped core is spaced apart from the second E-shaped core. A primary coil is wound around a center leg of the first E-shaped core and a secondary coil is wound around a center leg of the second E-shaped core. A magnetic flux generated from the primary coil is cut due to the magnetic resistance characteristics of the I-shaped core to vary the inductance of the secondary coil, to thereby form enclosed loops of magnetic flux inside the first and second E-shaped cores, respectively.

9 Claims, 5 Drawing Sheets

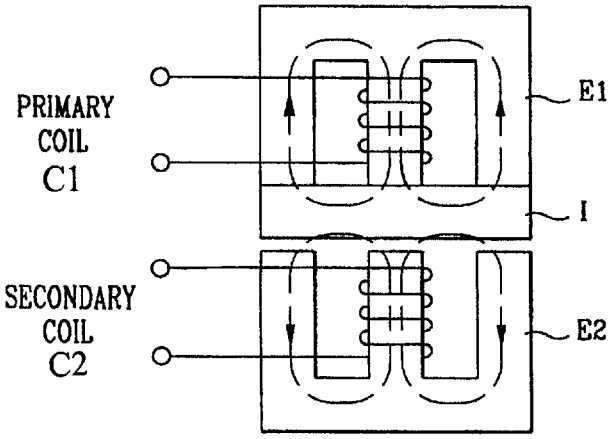
Fig. 6A
Fig. 6B
Fig. 6C
Fig. 6D
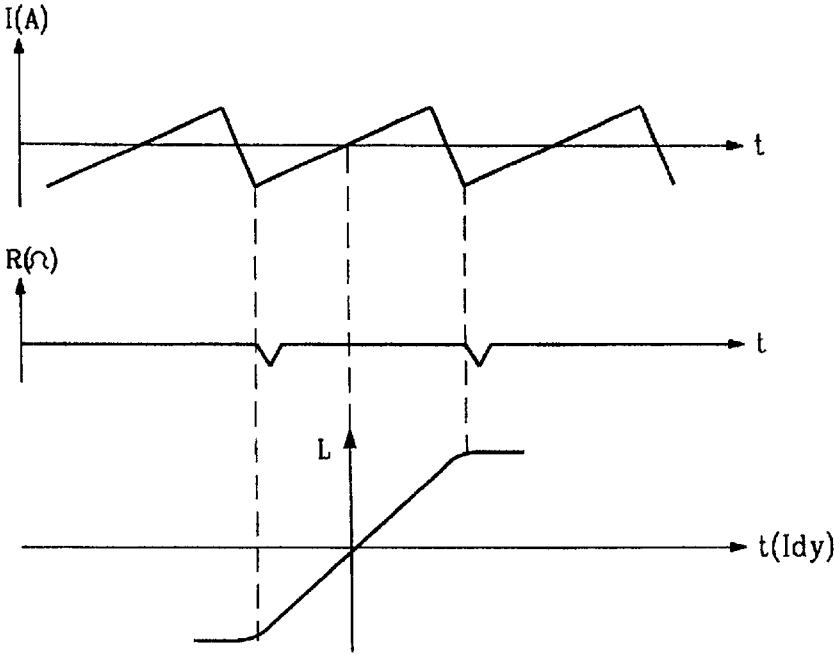

ELECTRIC CURRENT VARIABLE-TYPE INDUCTOR HAVING CLOSED LOOP CHARACTERISTICS AND A HORIZONTAL LINEARITY COMPENSATION CIRCUIT

CLAIM OF PRIORITY

This application makes reference to, incorporates the same herein, and claims all benefits accruing under 35 U.S.C §119 from an application entitled *Electric Current Variable-Type Inductor Having Closed Loop Characteristics And A Horizontal Linearity Compensation Circuit* earlier filed in the Korean Industrial Property Office on the 28$^{th}$ day of Dec. 1999, and there duly assigned Serial No. 99-63450.

FIELD OF THE INVENTION

The present invention relates to processes of varying an electric current and variable-type inductors having closed loop characteristics, and, more particularly, to horizontal linearity compensation processes and circuits to compensate for broadband horizontal linearity with low electric power by using the electric current variable-type inductor having closed loop characteristics.

BACKGROUND OF THE INVENTION

In general, a cathode ray tube (CRT) employed for a video display device uses a principle of displaying different brightness and colors as different amounts of electron beams strike fluorescent materials of red, green, and blue (RGB) colors coated on the surface of the cathode ray tube according to a intensity of a video signal, which is widely used because of the low price and the excellent display performance. The video card supports various video modes for each of which different horizontal and vertical frequencies are generated based on a resolution to be displayed. As the horizontal and vertical frequencies are increased from low to high, display flickering is reduced so that the eye fatigue of a user is lessened.

Multi-mode video display devices are referred to as video display devices that are compatible with two or more video modes, with a deflection circuit and various deflection compensation circuits used to adjust diverse horizontal frequencies adjustment of image sizes and positions. The left and right widths from the center of the screen are not symmetrical if a horizontal frequency is varied for a multi mode video display device. In order to compensate the left and right widths to be symmetrical, a horizontal linearity compensation circuit is generally provided in the video display device. The horizontal linearity compensation circuit typically includes a compensation current supply that provides a compensation current that varies in magnitude and direction, and a current variable inductor is connected in series to the horizontal deflection coil in order to compensate the magnitude and direction of a sawtooth current flowing in a horizontal deflection coil, in accordance with the magnitude and direction of the compensation current.

The inductance of the current variable inductor varies in consonance with the horizontal frequency, so that the left and right widths of the screen with respect to the center of the screen are symmetrical. In order for the left and right widths of a screen to be adjusted to be exactly symmetrical, a current variable inductor may be constructed for a conventional horizontal linearity compensation circuit, with a primary coil is wound on the first drum core, a secondary coil is wound on the second drum core, and the first drum core is stacked on the second drum core. Generally, the number of turns of the primary coil is substantially greater than the number of turns in the secondary coil. In order to maintain a proper inductance, the ferrite magnet is mounted on the lower portion of the second drum core. The inductance change of the secondary coil changes according to the amount of magnetic flux generated by the primary coil. The magnetic flux is symmetrically generated in the left and right sides of the primary coil and the secondary coil to form an open loop outside the cores drum. When the degree of mutual coupling between the drum cores and the ferrite magnet deteriorates, a near short-circuit current flows in the primary and secondary coils to compensate horizontal linearity because an open loop type is applied to the current variable inductor using the first and second drum cores, and a ferrite magnet. Accordingly, we have found that a problem occurs because of the large number of turns required in the primary coil to generate a power loss.

Moreover, since the variable range is limited according to the magnitude of the horizontal deflection current, a lot of current in the primary coil flows in order to solve the limitation. Therefore, there exists another problem in that an additional loss of power occurs and then more heat is accordingly generated. We have also noticed that a further problem occurs when the uniformity of display brightness deteriorates because the electron beam in the cathode ray tube is distorted by the magnetic flux generated from the ferrite magnet.

SUMMARY OF THE INVENTION

Accordingly, it is an object of the present invention to provide an improved process of varying an electric current and variable-type inductor having closed loop characteristics.

It is another object to provide a process of varying an electric current and a variable-type inductor having closed loop characteristics with an I-shaped core arranged between two E-shaped cores.

It is still another object to provide a current variable inductor that exhibits closed loop characteristics with an I-shaped core arranged between two E-shaped cores.

It is yet another object to provide a horizontal linearity compensation circuit in order to compensate for broadband horizontal linearity with low power by using a current variable coil having the closed loop characteristics.

In order to achieve these and other objects, a current variable inductor having the closed loop characteristics according to the present invention is constructed by arranging a leg of a first E-shaped core and a leg of a second E-shaped core opposite to each other, arranging an I-shaped core between a first E-shaped core and a second E-shaped core, contacting the I-shaped core with the first E-shaped core, spacing the I-shaped core apart from the second E-shaped core, winding a primary coil around a center leg of the first E-shaped core, and winding a secondary coil around a center leg of the second E-shaped core.

Further, in order to achieve these objects, the horizontal linearity compensation circuit according to the present invention comprises a horizontal deflection part for deflecting a scanning electron beam in a horizontal direction by a sawtooth wave flowing in the horizontal deflection coil; a controller outputting a control signal according to a horizontal frequency; a compensation current supply part for outputting a compensation current of which magnitude and direction vary according to the control signal; and an inductor having an I-shaped core arranged between a first E-shaped core and a second E-shaped core and having a primary coil wound around a center leg of the first E-shaped core and a secondary coil wound around a center leg of the second E-shaped core, and for compensating a magnitude and a direction of a sawtooth wave current by varying an inductance thereof according to a magnitude and a direction of the compensation current, wherein a leg of the first E-shaped core and a leg of the second E-shaped core are arranged opposite to each other, the I-shaped core is in contact with the first E-shaped core, the I-shaped core is spaced apart from the second E-shaped core, the compensation current flows in the primary coil, and the sawtooth wave current flows in the secondary coil. In contradistinction to conventional current variable inductors with open loop characteristics, a current variable inductor with the closed loop characteristics of the present invention, may be constructed with the number of turns in the primary and secondary coils greatly reduced so as to reduce the likelihood of a thermal breakdown of the coils, and prevent the electron beam in the cathode ray tube from being distorted by a magnetic flux generated from a ferrite magnet because the ferrite magnet has been eliminated. Moreover, a horizontal linearity compensation circuit constructed according to the principles of the present invention enables optimum display linearity to be attained by compensating a broadband horizontal linearity with a low power by using a current variable inductor having the closed loop characteristics.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIGS. 6A–6D are views explaining a current variable inductor having closed loop characteristics constructed as one embodiment according to the principles of the present invention.

DETAILED DESCRIPTION OF THE PREFERRED EMBODIMENT

Figure 1:
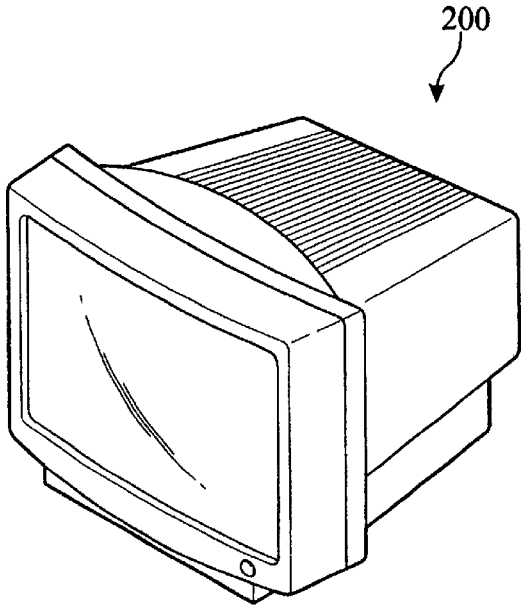
FIG. 1 is a perspective view of a video display device.
Figure 2:
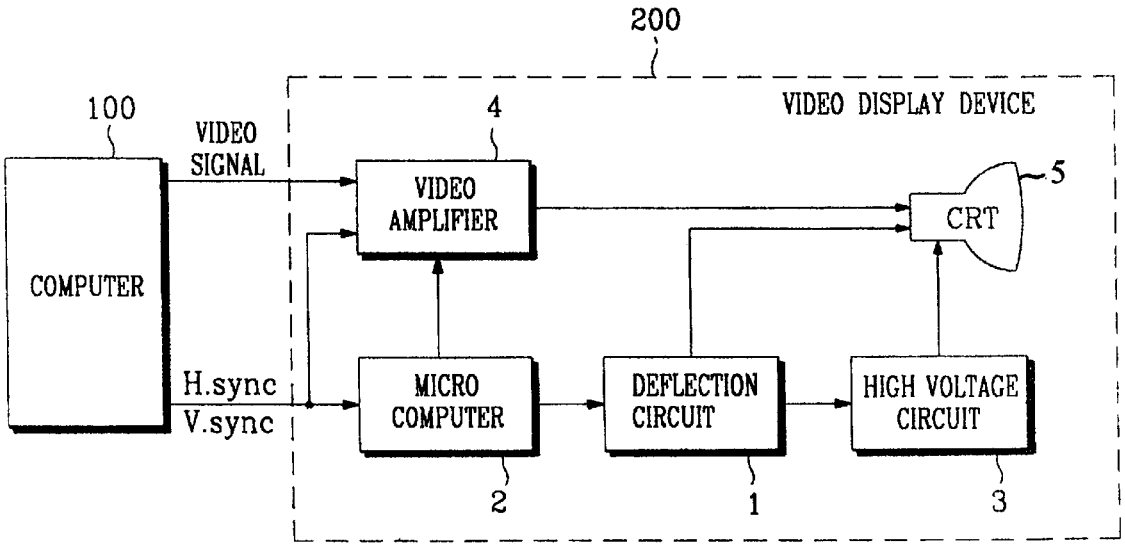
FIG. 2 is an entire block diagram for showing a general video display device employing a cathode ray tube.

Turning now to the drawings, FIGS. 1 and 2 illustrating a video display device 200 suitable for the practice of the instant invention. Video display device 200 may be constructed with a housing 202 encasing a cathode ray tube 5 that provides a video screen 204. Video display device 200 receives a video signal and a synchronization signal from a video card (not shown) of a computer so as to reproduce a varying video image on the screen 202 of the cathode ray tube. Video display device 200 employs a cathode ray tube 5, a deflection circuit 1, a microcomputer 2, a high voltage circuit 3, and a video amplifier 4. A red, green and blue (RGB) video signal input from a video card (not shown) of a computer 100, is amplified through the video amplifier 4, applied to the cathode terminal of the cathode ray tube 5, and then displayed on the screen of the cathode ray tube 5. In order to display the video signal on the screen of the cathode ray tube 5, a sawtooth wave current is supplied to a horizontal deflection coil and a vertical deflection coil to deflect an electron beam in the horizontal and vertical directions, to thereby form a raster on the entire screen of the cathode ray tube. The sawtooth wave current is generated from the deflection circuit 1 based on the horizontal synchronization signal and the vertical synchronization signal input from the video card of computer 100 to be supplied to the horizontal and vertical coils.

The video card supports various video modes for each of which different horizontal and vertical frequencies are generated based on a resolution to be displayed. As the horizontal and vertical frequencies are increased from low to high, display flickering is reduced so that the eye fatigue of a user is lessened. The multi-mode video display device is referred to as a video display device compatible with at least two or more video modes, in which adjustments of image sizes and positions, a deflection circuit, and various deflection compensation circuits are available according to diverse horizontal frequencies, for example, of about 30–75 Khz, output from a video card.

Figure 3:
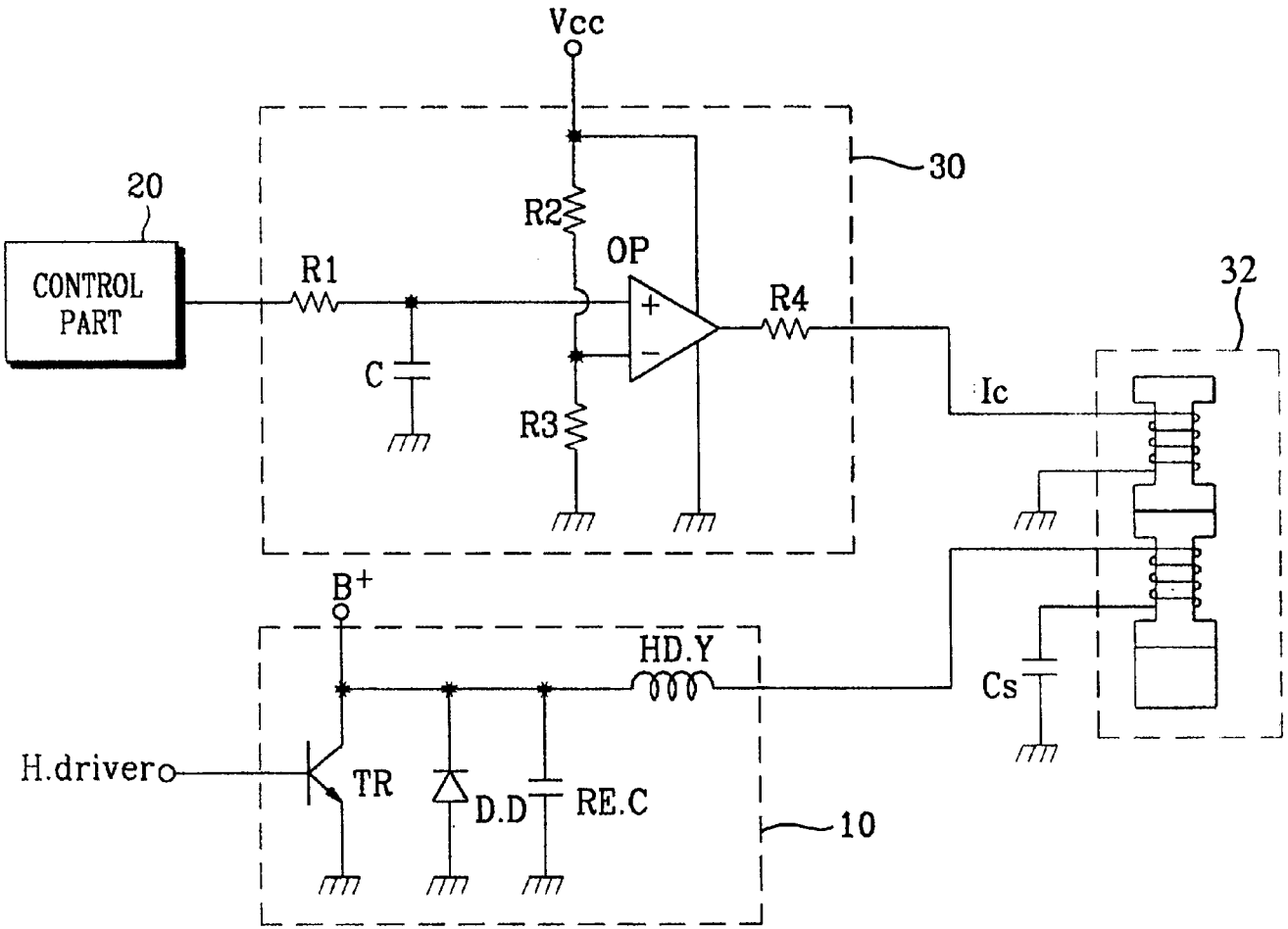
FIG. 3 is a schematic diagram showing a horizontal linearity compensation circuit in a video display device.

Turning now to FIG. 3, a horizontal linearity compensation circuit in a general video display device is constructed with a horizontal synchronization signal output from a video card (not shown) of a computer (not shown) being first modulated to a horizontal drive signal H.driver through a horizontal oscillation part (not shown) and a horizontal drive part (not shown) to be applied to the base of the horizontal output transistor (TR). As the horizontal output transistor TR is turned on and off, a sawtooth wave current is applied to a horizontal deflection coil HD.Y, so that a horizontal deflection of an electron beam is achieved. With a multi mode video display device however, the left and right widths from the center of the screen are not symmetrical if a horizontal frequency is varied, so that, in order to compensate the left and right widths to be symmetrical, a horizontal linearity compensation circuit is generally provided in the video display device. The horizontal linearity compensation circuit includes a control part, e.g., microcomputer, 20 that provides a control signal according to a horizontal frequency, a compensation current supply part 30 that provides a compensation current Ic that varies in a magnitude and direction according to the control signal, and a current variable inductor 32 connected in series to the horizontal deflection coil HD.Y in order to compensate the magnitude and a direction of a sawtooth current $I_{HDY}$ flowing in the horizontal deflection coil HD.Y in accordance with the magnitude and direction of the compensation current Ic. Consequently, control part 20 outputs a control voltage of 0–5V according to a horizontal frequency received from the video card (not shown), and the compensation current supply part 30 amplifies the control voltage of 0–5V to +Vcc~−Vcc so as to be applied to the primary coil of the current variable inductor 32. Therefore, the magnitude and direction of a current flowing in the second coil of the current variable inductor 32 according to a magnitude and a direction of a current flowing in the primary coil of the current variable inductor 32 varies, and an inductance of the current variable inductor 32 varies. That is, as the inductance of the current variable inductor 32 varies according to a horizontal frequency, the left and right widths of the screen with respect to the center of the screen become symmetrical.

Figure 4A:
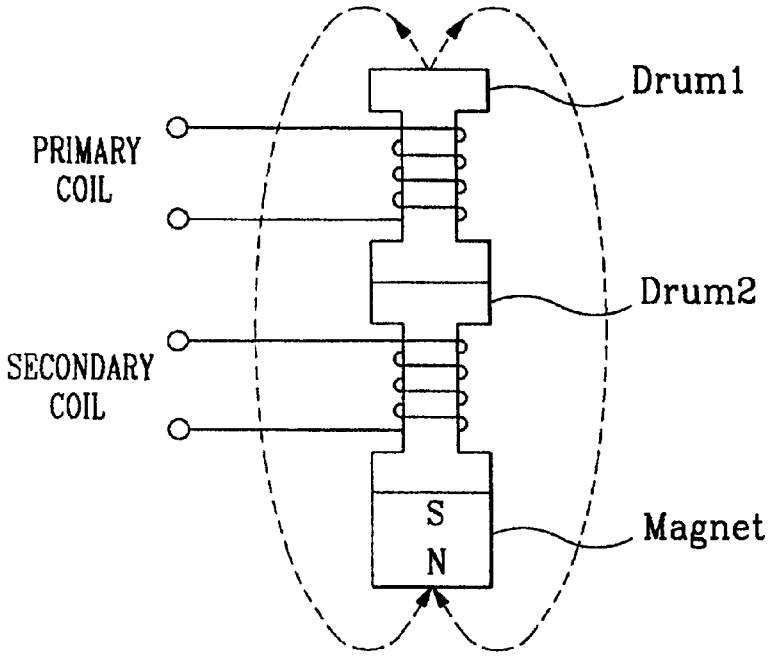
FIGS. 4A and 4B are views for explaining a general current variable inductor having open loop characteristics.
Figure 4B:
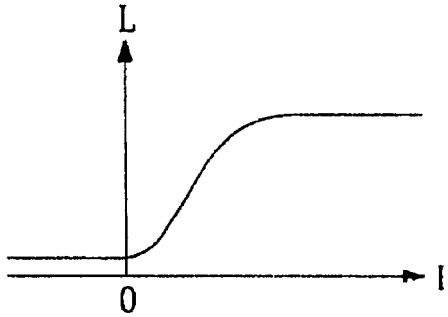

FIGS. 4A and 4B explain the principles of construction and operation of a current variable inductor with open loop characteristics. In order for the left and right widths of a screen to be adjusted to be exactly symmetrical, a current variable inductor 32 as shown in FIG. 4A, having a first drum core 11, a second drum core 21, and a ferrite magnet 23 is used for a conventional horizontal linearity compensation circuit. A primary coil is wound on the first drum core 11, a secondary coil is wound on the second drum core 21, and the first drum core 11 is stacked on the second drum core 21. Generally, the number of turns of the primary coil is about "1200TN", and the number of turns of the secondary coil is about "25TN". Further, in order to maintain a proper inductance, the ferrite magnet 23 is mounted on the lower portion of the second drum core 21. Consequently, in the two coordinate graph of FIG. 4B showing electrical current as a function of inductance, a positive active region of saturation region is used to properly compensate the one-way current flowing in the horizontal deflection coil HD.Y in order to obtain an optimum linearity. That is, a saturation region is generated by the ferrite magnet 23.

Inductance in the secondary coil changes according to the amount of magnetic flux generated by the primary coil. The magnetic flux, as shown in FIG. 4A, is symmetrically arrayed in the left and right sides of the primary coil and the secondary coil to form an open loop outside the first and second drum cores 11, 21. When the degree of mutual coupling between the first and second drum cores 11, 21 and the ferrite magnet 23 deteriorates, and since an open loop type is applied to the current variable inductor 32 using the first drum core 11, the second drum core 21, and the ferrite magnet 23, a short-circuit current flow nearly occurs in the primary and secondary coils 11,21, so that a lot of short-circuit current flows to compensate for the horizontal linearity. Accordingly, there exists a problem in that the large number of turns, 1200TN, is required in the primary coil to thereby generate a power loss. Further, since a variable range is limited according to a magnitude of a horizontal deflection current, a lot of current in the primary coil flows in order to solve the limitation. Therefore, another problem occurs because additional power loss is caused and then more heat is, accordingly, generated. Moreover, the brightness of the display deteriorates because the electron beam in the cathode ray tube 5 is distorted by the magnetic flux generated from ferrite magnet 23.

Figure 5:
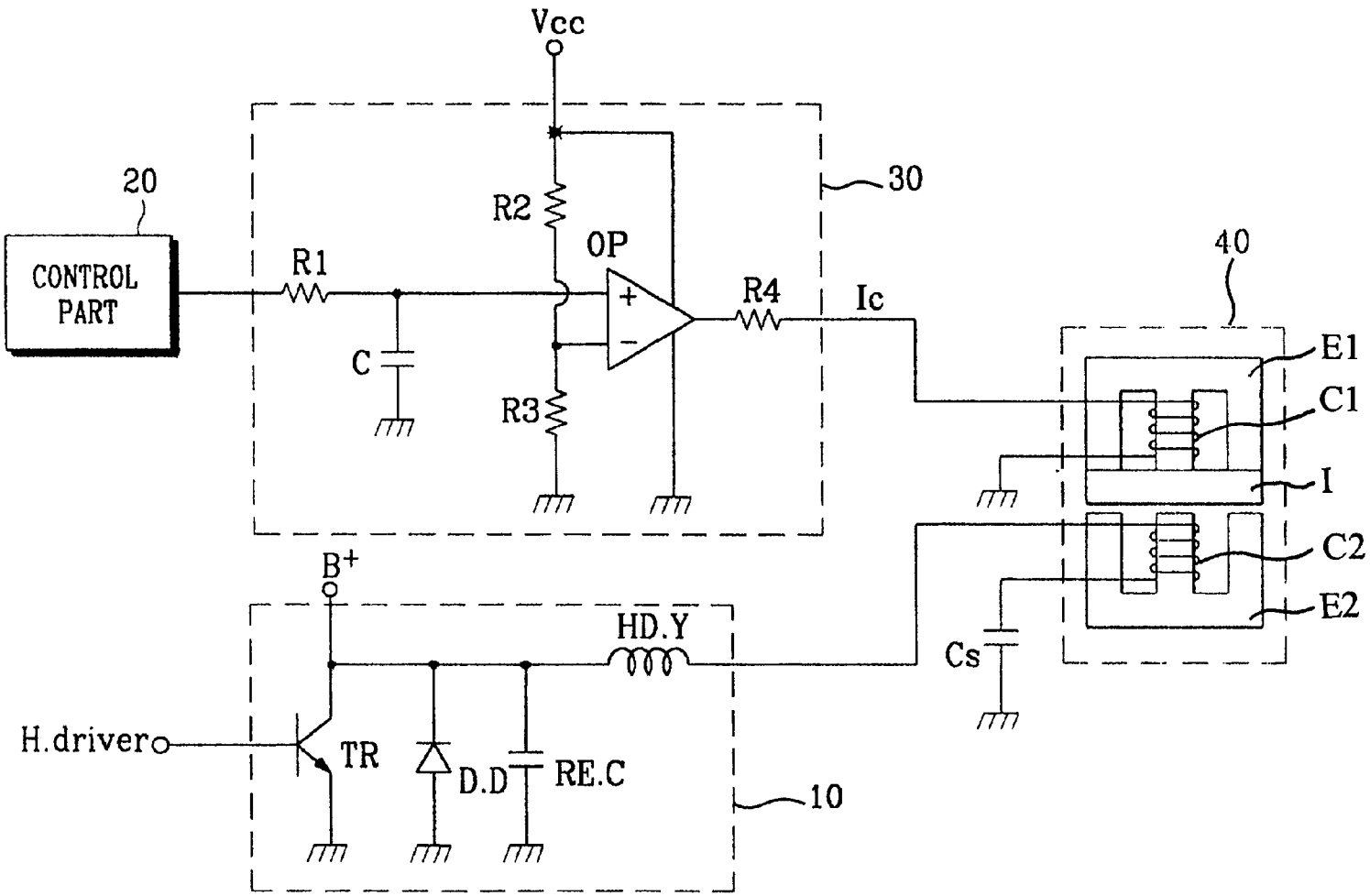
FIG. 5 is a schematic diagram illustrating a horizontal linearity compensation circuit for a video display device according to an embodiment of the present invention.

Turning now to FIG. 5, hereafter a horizontal linearity compensation circuit suitable for a video display device constructed as an embodiment of the present invention, will be described in detail with reference to the accompanying drawings. FIG. 5 is a view for showing a horizontal linearity compensation circuit for a video display device according to an embodiment of the present invention.

As shown in FIG. 5, a circuit constructed as an embodiment of the present invention may incorporate a horizontal deflection part 10 for deflecting a scanning electron beam in a horizontal direction by a sawtooth wave $I_{DHY}$ flowing in the horizontal deflection coil HD.Y; a controller 20 for outputting a control signal according to a horizontal frequency; a compensation current supply part 30 for outputting a compensation current Ic of which magnitude and direction vary according to the control signal; and an inductor 40 having an I-shaped core I arranged between an E-shaped core E1 and an E-shaped core E2, and having a primary coil C1 wound around a center leg of the E-shaped core E1 and a secondary coil C2 wound around a center leg of the E-shaped core E2, and for compensating a magnitude and a direction of a sawtooth wave current $I_{DHY}$ by varying an inductance thereof according to a magnitude and a direction of the compensation current Ic, wherein the legs of the E-shaped core E1 and the legs of the E-shaped core E2 are arranged opposite to each other, i.e., extend towards each other, the I-shaped core I is in contact with the legs of the E-shaped core E1, the I-shaped core I is spaced apart from the legs of E-shaped core E2, the compensation current Ic flows in the primary coil C1, and the sawtooth wave current IDHY flows in the secondary coil C2. Here, the controller 20 outputs a control voltage of 0~+Va to the compensation current supply part 30 according to a frequency of the horizontal synchronization signal input from external. Further, the compensation current supply part 30 supplies a compensation voltage of −Vcc~+Vcc to the inductor 40 according to the control voltage of 0~+Va input from controller 20, and is constituted with an operational amplifier OP receiving the control voltage of 0~+Va at a non-inverting input terminal thereof and receiving a reference voltage at an inverting input terminal thereof. Operational amplifier OP outputs a compensation voltage of 0~+Vcc to inductor 40 if a voltage input at the non-inverting input terminal is larger than a voltage input at the inverting input terminal, and outputs a compensation voltage of −Vcc~0 to inductor 40 if a voltage input at the non-inverting input terminal is smaller than a voltage input at the inverting input terminal.

Hereinafter, operations and effects of the circuit according to the embodiment of the present invention having a structure as stated above will be described in detail. First, a horizontal synchronization signal output from a video card (not shown) is properly modulated to a horizontal drive signal H.driver through a horizontal oscillation part (not shown) and a horizontal drive part (not shown) so as to be applied to the base of horizontal output transistor TR. At this time, as the horizontal output transistor TR is turned on and off, a sawtooth wave current flows in the horizontal deflection coil HD.Y, so that a horizontal deflection of an electron beam is carried out.

At this time, in order to symmetrically adjust the left and right widths of a displayed image, the controller 20 outputs a control voltage of 0~5V according to the horizontal frequency received from the video card, the compensation current supply part 30 amplifies the control voltage of 0~5V to a voltage of +Vcc~−Vcc and then supplies the amplified control voltage to the primary coil C1 of the inductor 40. Accordingly, a magnitude and a direction of a current flowing in the secondary coil C2 varies according to a magnitude and a direction of a current flowing in the primary coil C1, varying an inductance of the inductor 40. That is, as the inductance of the inductor 40 varies according to a horizontal frequency, the left and right widths of a displayed image are adjusted to be exactly symmetrical.

FIGS. 6A through 6D are views for further explaining inductor 40 as having a closed loop characteristic according to an embodiment of the present invention. As shown in FIG. 6A, the current variable inductor having the closed loop characteristics according to an embodiment of the present invention is constructed by arranging E-shaped core E1 and E-shaped core E2 to be mirror images of each other. That is, the legs of E-shaped core E1 and the legs of the E-shaped core E2 are opposite to each other, i.e., extend towards each other. I-shaped core I is disposed between E-shaped core E1 and E-shaped core E2 such that I-shaped core I is in contact with the legs of E-shaped core E1 and adjacent to but spaced apart from the legs of E-shaped core E2, to thereby form closed loops inside the first and second E-shaped cores E1 and E2, respectively. Further, primary coil C1 is wound on a center leg of E-shaped core E1, and secondary coil C2 is wound on a center leg of E-shaped core E2, so that a magnetic flux generated from the primary coil C1 is continuously cut with the magnetic resistance characteristics of I-shaped core I to vary the inductance of secondary coil C2. Accordingly, as shown in FIG. 6A, a magnetic flux is symmetrically generated to the left and right sides of primary coil C1 and secondary coil C2, which forms closed loops inside E-shaped core E1 and E-shaped core E2.

The primary coil C1 is driven with a low power and the closed loop is formed. For example, even though the number of turns of the primary coil is reduced, to an extent of "300TN" (the number of turns of the primary coil is about "1200TN" as stated above in case of a general current variable inductor having the open loop characteristics), a drive current, small to an extent of 100 mA, is applied to primary coil C1, thus enough basic magnetic flux is generated in the primary coil C1. Further, even though the number of turns of the secondary coil C2 is reduced to an extent of "7TN" (the number of turns of the secondary coil is about "25TN" as stated above in case of an general current variable inductor having the open loop characteristic) with the closed loop formed, enough basic magnetic flux is generated.

In the meantime, the I-shaped core I disposed between the two E-shaped cores E1 and E2 plays a role of a shield in order for an alternate magnetic flux not to be leaked to the E-shaped core E1 while operated as a modulator of a magnetic flux generated from the E-shaped core E1 so that the magnetic permeability of the I-shaped core I is modulated according to a magnetic flux change. Accordingly,the magnetic flux generated from the primary coil C1 is continuously transferred to the magnetic resistance characteristics of the I-shaped core I (refer to FIG. 6C), and the inductance of the secondary coil C2 is changed according to a magnetic flux change set in the primary coil C1 (refer to FIG. 6D), which may indicate proper saturation characteristics according to a magnitude of a horizontal deflection current flowing in the secondary coil C2 so that a slope of a deflection current may be controlled.

At this time, in a graph showing currents versus inductances as shown in FIG. 6D, a positive active region of saturation regions is used to properly compensate a bidirectional current flowing in the horizontal deflection coil HD.Y for an optimum linearity. That is, a saturation region is generated by a gap existing between the E-shaped core E2 and the I-shaped core I. The present invention can control the horizontal linearity in a bidirectional way according to positive and negative polarities of a current applied to the primary coil as shown in FIG. 6D, compared to the conventional control of the horizontal linearity in one-way direction by using the ferrite magnet (refer to FIG. 4B).

The foregoing paragraphs contemplate processes of varying an electric current and variable-type inductors constructed with closed loop characteristics obtained by using an I-shaped core arranged between two E-shaped cores, and to horizontal linearity compensation processes and circuits to compensate for broadband horizontal linearity with low electric power by using the electric current variable-type inductor having closed loop characteristics. As stated in the foregoing paragraphs, since a current variable inductor exhibiting a closed loop characteristics has the number of turns of the primary and secondary coils greatly reduced, as distinguished from a conventional current variable inductor exhibiting open loop characteristics, thermal breakdown of the coils may be minimized. Moreover, the phenomenon of distortion of the electron beam within the cathode ray tube due to the magnetic flux generated from the ferrite magnet is substantially reduced because the ferrite magnet is removed. Furthermore, embodiments of the present invention provide an optimum screen linearity because the broadband horizontal linearity is compensated with a low power by using a current variable inductor having closed loop characteristics.

What is claimed is:

1. A horizontal linearity correction inductor having closed loop characteristics, comprising an I-shaped core arranged between a first E-shaped core and a second E-shaped core, a leg of the first E-shaped core and a leg of the second E-shaped core being arranged opposite to each other, the I-shaped core being in contact with the first E-shaped core, and the I-shaped core being spaced apart from the second E-shaped core.

2. The horizontal linearity correction inductor as set forth in claim 1, further comprising:

a primary coil wound on a center leg of the first E-shaped core, and a secondary coil wound lit on a center leg of the second E-shaped core, so that a magnetic flux generated from the primary coil is continuously cut with magnetic resistance characteristics of the I-shaped core to vary the inductance of the secondary coil, characterized in that closed loops of magnetic flux are formed in the first and second E-shaped cores, respectively.

3. A horizontal linearity compensation circuit, comprising:

a horizontal deflection part for deflecting a scanning electron beam in a horizontal direction by a sawtooth wave flowing in a horizontal deflection coil;

a controller for outputting a control signal according to a horizontal frequency;

a compensation current supply part for outputting a compensation current of which magnitude and direction vary according to the control signal; and a current variable inductor having an I-shaped core arranged between a first E-shaped core and a second E-shaped core and having a primary coil wound around a center leg of the first E-shaped core and a secondary coil wound around a center leg of the second E-shaped core, said inductor compensating a magnitude and a direction of a sawtooth wave current by varying an inductance thereof according to a magnitude and a direction of the compensation current, wherein legs of the first E-shaped core and legs of the second E-shaped core extend toward each other, the I-shaped core being in contact with the first E-shaped core, the I-shaped core being spaced apart from the second E-shaped core, the compensation current flows in the primary coil, and the sawtooth wave current flows in the secondary coil.

4. The compensation circuit As set forth in claim 3, wherein the controller outputs a control voltage of 0~+Va to the compensation current supply part according to a frequency of the horizontal synchronization signal.

5. The compensation circuit as set forth in claim 4, wherein the compensation current supply part supplies a compensation voltage of −Vcc~+Vcc to the inductor in response to the control voltage of 0~+Va input from the controller.

6. The compensation circuit as set forth in claim 5, wherein the compensation current supply part comprises an operational amplifier receiving the control voltage of 0~+Va at a non-inverting input terminal thereof and receiving a reference voltage at an inverting input terminal thereof, said operational amplifier outputting a compensation voltage of 0~+Vcc to the inductor if a voltage input to the non-inverting input terminal is larger than a voltage input to the inverting input terminal, and outputting a compensation voltage of −Vcc~0 to the inductor if a voltage input to the non-inverting input terminal is smaller than a voltage input to the inverting input terminal.

7. A horizontal linearity compensation circuit, comprising a horizontal linearity correction inductor having closed loop characteristics, said horizontal linearity correction inductor comprising:

a first E-shaped core;

a second E-shaped core disposed adjacent to said first E-shaped core such that said second E-shaped core forms a mirror image of said first E-shaped core; and an I-shaped core disposed between said first E-shaped and said second E-shaped core such that said I-shaped is in contact with said first E-shaped core and said I-shaped core is spaced apart from said second E-shaped core.

8. The horizontal linearity compensation circuit as set forth in claim 7, further comprising:

a primary coil wound on a center leg of said first E-shaped core; and a secondary coil wound on a center leg of the second E-shaped core, wherein a magnetic flux generated from said primary coil is continuously cut with magnetic resistance characteristics of said I-shaped core to vary the inductance of said secondary coil such that closed loops of magnetic flux are formed in the first and second E-shaped cores, respectively.

9. The horizontal linearity compensation circuit as set forth in claim 8, further comprising:

a horizontal deflection part for deflecting a scanning electron beam in a horizontal direction by a sawtooth wave flowing in a horizontal deflection coil;

a controller for outputting a control signal according to a horizontal frequency; and a compensation current supply part for outputting a compensation current of which magnitude and direction vary according to the control signal, said compensation current being supplied to said primary coil.

* * * * *